US005376910A

United States Patent [19]

Geringer et al.

[11] Patent Number: 5,376,910

[45] Date of Patent: Dec. 27, 1994

[54] ELECTROMAGNET COIL ASSEMBLY AND MOUNTING APPARATUS AND METHOD FOR USE IN INSTALLING SAME

[76] Inventors: Arthur Geringer, 5029 E. Jacobs Ct., Agoura, Calif. 93021; Richard Geringer, 12628 Ambermeadow, Moorpark, Calif. 93021; David A. Geringer, 28364 Balkins, Agoura, Calif. 91301

[21] Appl. No.: 82,864

[22] Filed: Jun. 28, 1993

[51] Int. Cl.[5] ..... H01F 7/00; H01F 7/20; E05C 17/56

[52] U.S. Cl. ..... 335/278; 335/285; 292/251.5

[58] Field of Search ..... 335/260, 278, 292, 294, 335/295; 292/251.5

[56] References Cited

U.S. PATENT DOCUMENTS

| | | | |
|---|---|---|---|
| 3,451,707 | 6/1969 | Barry | 292/251.5 |
| 4,322,702 | 3/1982 | Bosch | 335/202 |
| 4,516,114 | 5/1985 | Cook | 340/542 |
| 4,609,910 | 9/1986 | Geringer | 340/545 |
| 4,652,028 | 3/1987 | Logan | 292/251.5 |
| 4,720,128 | 1/1988 | Logan, Jr. | 292/251.5 |
| 4,981,312 | 1/1991 | Frolov | 292/251.5 |
| 5,000,497 | 3/1991 | Geringer | 292/251.5 |
| 5,133,581 | 7/1992 | Coleman | 292/251.5 |
| 5,184,854 | 2/1993 | Chen | 292/251.5 |
| 5,261,713 | 11/1993 | Fischbach | 292/251.5 |

*Primary Examiner*—Leo P. Picard
*Assistant Examiner*—Stephen T. Ryan
*Attorney, Agent, or Firm*—John J. Posta, Jr.

[57] ABSTRACT

An improved electromagnetic coil assembly for use with an electromagnetic door locking mechanism is disclosed which electromagnetic coil assembly incorporates an improved housing construction allowing the electromagnetic coil assembly to be easily and conveniently installed in its operating position on the frame of the door utilizing the electromagnetic locking mechanism. The electromagnet core itself is made of a plurality of thin, flat electromagnet core laminations which are placed in a stacked array in a U-shaped channel member, with thin welds between the tops of the legs of the "U" and the side edges of the stacked electromagnet core laminations being used to maintain the configuration of the array. In the preferred embodiment, an electromagnet housing member containing the electromagnet core is mounted to a mounting plate affixed to a door frame using mounting bolts located within the electromagnet housing member to facilitate both simple installation and quick and easy replacement of the electromagnet coil assembly.

24 Claims, 5 Drawing Sheets

ELECTROMAGNET COIL ASSEMBLY AND MOUNTING APPARATUS AND METHOD FOR USE IN INSTALLING SAME

IDENTIFICATION OF RELATED PATENT APPLICATION

This application is related to U.S. patent application No. 07/964,131, entitled "Electronic Delayed Egress Locking System," which patent application is hereby incorporated herein by reference.

BACKGROUND OF THE INVENTION

Field of the Invention

The present invention relates generally to security systems for doors which utilize electromagnetic locking, and more particularly to an improved electromagnetic coil assembly for use with an electromagnetic door locking mechanism, which electromagnetic coil assembly incorporates an improved housing construction allowing the electromagnetic coil assembly to be easily and conveniently installed in its operating position on the frame of the door utilizing the electromagnetic locking mechanism.

Security doors have evolved over the years from simple doors with heavy duty locks to sophisticated egress and access control devices. In bygone times, heavy duty chains and locks were the norm on security doors which were not generally used, or which were used to prevent theft or vandalism. However, fire codes have made such relatively simple door locking systems obsolete, at least in most developed countries. Emergency exit doors are required by law to be provided in all commercial buildings, and such doors must be operative in the event of a fire, earthquake, or other emergency.

These exit doors are typically mechanical in nature, and are provided with heavy horizontal push bars, which unlock the door upon actuation of the push bar. Such mechanical mechanisms are subject to tampering using simple mechanical tools such as pry bars, and do not deter access by even relatively unsophisticated criminals.

As might be expected, the art reflects a number of more sophisticated locking mechanisms. A series of such devices is found in U.S. Pat. No. 4,257,631, in U.S. Pat. No. 4,328,985, in U.S. Pat. No. 4,354,699, in U.S. Pat. No. 4,652,028, and in U.S. Pat. No. 4,720,128, all to Logan, Jr. or Logan, Jr. et al. The Logan, Jr. patents begin with the Logan, Jr. '631 patent, which describes a system activated by a push bar which, upon depression, moves a switch carried by the door to sound an alarm and start a timer delay. After the delay, the door is unlocked.

The Logan '985 patent teaches a hydraulic system for accomplishing the delay prior to unlocking the door, and the Logan '699 patent describes a retrofit locking device of the same type, but usable with any door latching system. Such hydraulic systems are relatively complex, and present a substantial maintenance problem over time.

The Logan et al. '028 patent and the Logan, Jr. et al. '128 patent both teach an electromagnet mounted on a door jamb, an armature on the door held by the electromagnet to retain the door in the closed position, and a switch used to indicate when the door is being opened or tampered with. The Logan, Jr. et al. '128 patent adds a set of contacts to confirm that the armature properly contacts the electromagnet. These electromagnetic systems represented a substantial improvement in the art of door locking devices.

U.S. Pat. No. 4,439,808, to Gillham, describes another system which also uses an armature on a door and an electromagnet on the door jamb. The armature has shoulders to retain the door in the closed position even if someone exerts enough pressure on the door to otherwise slide the armature off of the electromagnet. U.S. Pat. No. 4,439,808, to Gillham, is hereby incorporated herein by reference.

Two other patents are relevant, particularly since they are both assigned to the assignee of the present invention. Specifically, these patents are U.S. Pat. No. 4,609,910 and U.S. Pat. No. 5,000,497, both to Geringer et al. The Geringer et al. '910 patent teaches a system with an armature on a door, an electromagnet on a door jamb, and a switch used to tell when an attempt is made to open the door. The Geringer et al. '497 patent teaches a novel door-mounted armature and door jamb-mounted electromagnet. U.S. Pat. No. 4,609,910 and U.S. Pat. No. 5,000,497 are both hereby incorporated herein by reference.

While these references represent a substantial improvement in the state of the art to date, there are still several disadvantages and problems inherent in the design and construction of presently known electromagnet core assemblies. For example, more inexpensive electromagnet cores may use a solid iron core, which results in poorer electromagnet characteristics. It is thus the practice on all but the cheapest electromagnet cores to utilize a laminated iron core, with the laminations typically being held together in a potted assembly. While this is an acceptable solution, it is far from optimal and may result in non-uniform laminated cores.

Another significant problem with presently known electromagnet core assemblies is that they are typically placed in a box, which is then screwed to the frame of the door to be secured. Little thought has been placed in designing an optimal interface with the door frame. As a result, typical electromagnet core assemblies are both difficult to install, and highly subject to tampering.

It is accordingly a primary objective of the present invention that it provide an improved design and related method of assembly for a laminated electromagnet core. It is also an objective that the construction and design of the improved electromagnet core enhance the manufacturability of the laminated electromagnet core, while simultaneously resulting in an electromagnet core assembly which exhibits excellent electrical and magnetic core characteristics. In addition, it is also an objective that the improved design and related improved method of assembly are necessarily both simple to accomplish and highly repeatable, thereby making the resulting electromagnet cores consistent in both construction and performance.

With regard to the electromagnet core assembly itself, it is an objective of the present invention that the apparatus which contains the improved electromagnet core and the electromagnet coil winding be designed to exhibit ease of initial installation as a primary feature. In addition, it is a further objective that ease of replacement of the electromagnet core assembly be extremely simple and quick to accomplish, thereby making thee present invention easier to service than any other similar system. It is a further objective of the present invention that the improved electromagnet core assembly utilize modular assembly to further enhance its serviceability. Despite these advantages, it is essential that the improved electromagnet core assembly be tamper-resistant to at least as high a degree as the best of the previously known devices.

The electromagnet core assembly of the present invention must also be of a construction which is both durable and long lasting, and it should also require that essentially no maintenance be provided by the user. In order to enhance the market appeal of the apparatus of the electromagnet core assembly of the present invention, it should also be of inexpensive construction to thereby afford it the broadest possible market. Finally, it is also an objective that all of the aforesaid advantages and objectives of the electromagnet core assembly of the present invention be achieved without incurring any substantial relative disadvantage.

SUMMARY OF THE INVENTION

The disadvantages and limitations of the background art discussed above are overcome by the present invention. With this invention, two aspects result in the substantial improvements to and resulting advantages over previously known electromagnet coil assemblies. The first aspect is an improved electromagnet core design and method of manufacture, and the second aspect is an improved electromagnet core assembly mounting design and related method of mounting the electromagnet core assembly.

With regard to the first aspect, the best possible electromagnet core characteristics are retained by a laminated core construction in which each of the electromagnet core laminations resembles a flat, primitive "E" with three legs extending orthogonally from a base segment. The two sides of the electromagnet coil winding will be placed between adjacent pairs of the legs of the W-shaped electromagnet core laminations after the electromagnet core laminations are assembled into an electromagnet core.

The electromagnet core laminations are assembled together into a U-shaped channel member which has sides slightly shorter than the sidelegs of the electromagnet core laminations. The sequence of electromagnet core laminations is installed in an aligned, longitudinally extending sequence in the U-shaped channel member to form two slots between the adjacent pairs of the legs of the E-shaped laminations. The top edges of the U-shaped channel member are then welded to the adjacent side legs of the electromagnet core laminations, thereby retaining the laminations in a precise and perpetual alignment, and completing the construction of the electromagnet core itself. The electromagnet coil winding is then installed onto the electromagnet core to complete the construction of the electromagnet assembly.

An electromagnet housing is used to contain the electromagnet assembly, which is removably installed into the interior of a electromagnet housing member with the E-shaped legs of the electromagnet core laminations of the electromagnet core extending toward an open side of the electromagnet housing member. An electromagnet housing cover is used to enclose the electromagnet assembly inside the electromagnet housing member, with only the tops of the E-shaped legs of the electromagnet core laminations of the electromagnet core extending through three slots contained in the electromagnet housing cover in an essentially flush manner with the outer surface of the electromagnet housing cover.

The novel configuration of the electromagnet housing is that it contains therein hardware means for mounting itself to a mounting plate. In the preferred embodiment, this hardware means comprises at least two mounting bolts contained within the assembled electromagnet housing. The preferred manner of accomplishing this is by providing means for holding the mounting bolts within the assembled electromagnet housing.

In the preferred embodiment, the electromagnet housing member has, in addition to the open side which the E-shaped legs of the electromagnet core laminations of the electromagnet core extend toward, two additional open sides which are the sides the opposite ends of the electromagnet core are oriented toward. The electromagnet housing cover is U-shaped (the "U" is relatively wider than it is tall) to cover the three open sides of the electromagnet housing member. The sides of the "U" formed by the electromagnet housing cover (which define the end walls of the electromagnet housing cover) are relatively thicker than the base portion of the "U", and each contain therein one or more apertures for holding mounting bolts.

The mounting bolts are no longer than the width of the sides of the "U" formed by the electromagnet housing cover, and thus will fit completely the apertures contained in the sides of the "U" formed by the electromagnet housing cover, The apertures are designed to allow the mounting bolts to be advanced considerably out of the sides of the "U" formed by the electromagnet housing cover, and in fact out of the electromagnet housing itself.

A mounting plate designed to be fastened to the frame of a door has threaded apertures in a pattern to receive the mounting bolts, thereby allowing the electromagnet housing member to be mounted onto the mounting plate and the door frame. In the preferred embodiment, the mounting plate and the electromagnet housing member include engaging portions designed to require the electromagnet housing member to be engaged with the mounting plate by sliding it laterally with respect to the door frame. This feature further enhances the secure mounting of the electromagnet housing assembly onto the door frame.

In the preferred embodiment, once the electromagnet housing cover is mounted onto the electromagnet housing member, the mounting bolts may not be removed from the electromagnet housing. Access apertures are provided to enable the mounting bolts to be driven by the end of a tool inserted into the access apertures.

In the preferred embodiment, the electromagnet housing member and the electromagnet housing cover are made of either cast or machined (or a combination thereof) metal. In an alternate embodiment, both the electromagnet housing member and the electromagnet housing cover are made of pan-bent sheet metal. In this alternate embodiment, cylindrical inserts having apertures therein for holding the mounting bolts are soldered or brazed into the interior of the electromagnet housing member. In this alternate embodiment, the electromagnet housing member is open only on the side the W-shaped legs of the electromagnet core laminations of the electromagnet core extend toward, and the electromagnet housing cover encloses only the one side. This embodiment does not include the engaging portions between the electromagnet housing member and the mounting plate. In fact, if desired a mounting plate may not be used, with the frame of the door being drilled and tapped in the proper pattern to receive the mounting bolts.

It may therefore be seen that the present invention teaches an improved design and related method of assembly for a laminated electromagnet core. The construction and design of the improved electromagnet core significantly enhance the manufacturability of the laminated electromagnet core, while simultaneously resulting in an electromagnet core assembly which exhibits excellent electrical and magnetic core characteristics. In addition, the improved design and related improved method of assembly of the present invention are simple to accomplish, and are also highly repeatable, thereby making the electromagnet cores produced consistent in both construction and performance.

The electromagnet core assembly of the present invention exhibits unparalleled ease of initial installation, both in terms of time required to install it and also in absolute simplicity of installation. In addition, replacement of the electromagnet core assembly is both simple and quick to accomplish, thereby making the electromagnet core assembly of the present invention easier to service than any other similar apparatus. The improved electromagnet core assembly utilizes modular assembly to enhance its serviceability, resulting in a lowering of overall costs involved in servicing the apparatus. Despite these advantages, the improved electromagnet core assembly of the present invention is tamper-resistant to at least as high a degree as the best of the previously known devices.

The electromagnet core assembly of the present invention is of a construction which is both durable and long lasting, and it also requires essentially no maintenance to be provided by the user. In order to enhance the market appeal of the apparatus of the electromagnet core assembly of the present invention, it is of relatively inexpensive construction to thereby afford it the broadest possible market. Finally, all of the aforesaid advantages and objectives of the electromagnet core assembly of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

Figure 1:
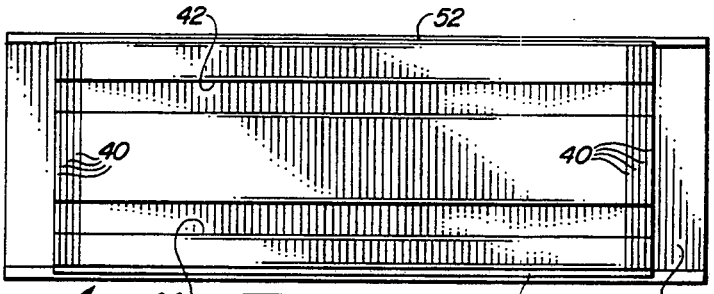
FIG. 1 is a top plan view of an electromagnet core constructed according to the teachings of the present invention, showing the electromagnet core laminations mounted in a U-shaped channel member to form two slots between adjacent pairs of legs.
Figure 3:
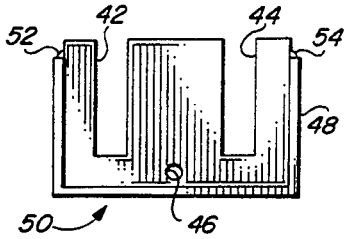
FIG. 3 is an end view of the electromagnet core illustrated in FIGS. 1 and 2, showing the W-shaped configuration of one of the electromagnet core laminations and an end view of the two slots between adjacent pairs of legs of the "E"
Figure 2:
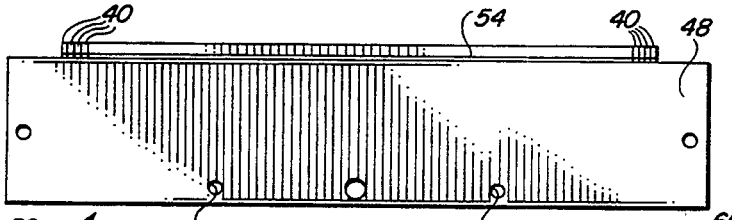
FIG. 2 is a side view of the electromagnet core illustrated in FIG. 1, showing one of the welds securing one of the top edges of the U-shaped channel to the sides of the electromagnet core laminations to retain the electromagnet core laminations in position.

The preferred embodiment of the present invention utilizes an electromagnet core having a unique design making it both easy to manufacture and highly precise. Referring to FIGS. 1 through 3, a plurality of thin, flat, E-shaped electromagnet core laminations 40 are stacked together. The electromagnet core laminations 40 resemble a primitive "E", with three legs extending from a base, as best shown in FIG. 3. Adjacent pairs of the legs of the "E" are spaced apart, so that the stack of the electromagnet core laminations 40 forms two slots 42 and 44, also best shown in FIG. 3.

A small aperture 46 extends centrally through the base portion of the "E", as seen in FIG. 3. A rod (not shown) may be temporarily inserted into the apertures 46 in the stack of electromagnet core laminations 40 to align them during their assembly into a stack.

The stack of electromagnet core laminations 40 is placed into a U-shaped channel member 48, which is longer than the stack of electromagnet core laminations 40, as is best shown in FIGS. 1 and 2. The stack of electromagnet core laminations 40 are then properly located in the U-shaped channel member 48, and may be compressed by a stacking press (not shown), as is well known in the lamination art.

Note that the height of the sides of the electromagnet core laminations 40 is slightly higher than is the height of the side legs of the U-shaped channel member 48. This is necessary to facilitate the assembly of the electromagnet core laminations 40 and the U-shaped channel member 48 into a unitary electromagnet core 50. This is accomplished by welding the top edges of the U-shaped channel member 48 to the sides of the electromagnet core laminations 40. Note the presence of the thin weld beads 52 and 54. The weld beads 52 and 54 retain the electromagnet core 50 in a highly precise configuration, which configuration and method of manufacturing the configuration represent a substantial improvement over potting laminations.

Referring now primarily to FIG. 2, two apertures 56 and 58 are drilled and tapped into the side of the electromagnet core 50 shown. The drilled and tapped apertures 56 and 58 are located slightly above the bottom of the U-shaped channel member 48, and extend into the electromagnet core laminations 40. The drilled and tapped apertures 56 and 58 are spaced longitudinally apart, and as a pair are approximately centrally located along the length of the U-shaped channel member 48.

Although the other side of the electromagnet core 50 is not illustrated in the figures, it looks exactly like the side illustrated in FIG. 2. Two additional drilled and tapped apertures 60 and 62 (not shown) are located on the other side of the electromagnet core 50, and are coaxial with the drilled and tapped apertures 56 and 58, respectively. This completes the construction of the electromagnet core 50 of the present invention.

Figure 6:
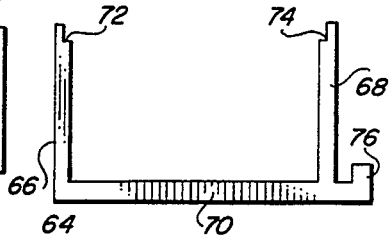
FIG. 6 is an end view of the electromagnet housing member illustrated in FIGS. 4 and 5, showing the open tops and ends of the electromagnet housing member into which the electromagnet core illustrated in FIGS. 1 through 3 will be mounted, and also showing the configuration of an engaging member located on the side of the electromagnet housing member which will be oriented toward the door frame member (not shown)
Figure 4:
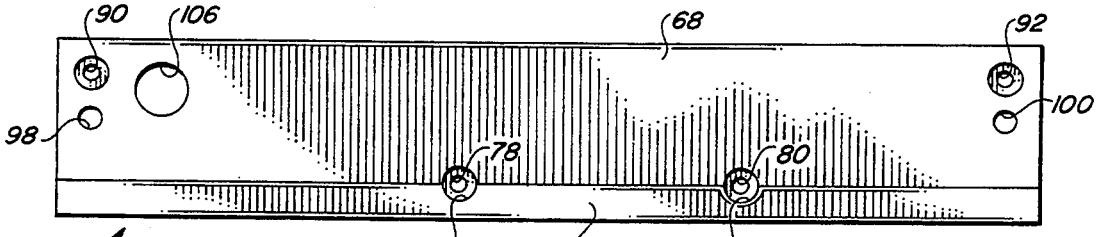
FIG. 4 is a side view of an electromagnet housing member constructed according to the preferred embodiment of the present invention, showing the various apertures in the side of the electromagnet housing member which will be mounted toward a door frame member (not shown)
Figure 5:
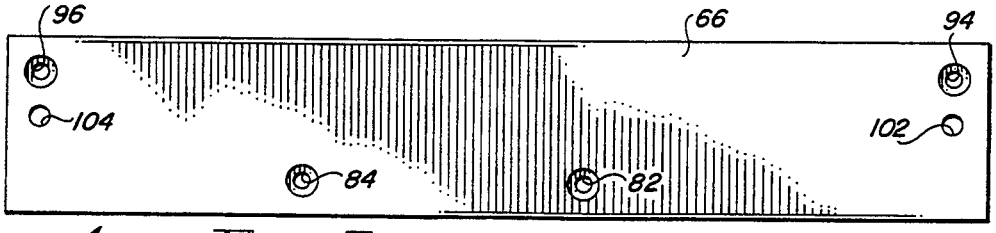
FIG. 5 is another side view of the electromagnet housing member illustrated in FIG. 4, showing the various apertures in the side of the electromagnet housing member which will be oriented away from the door frame member (not shown)
Figure 7:
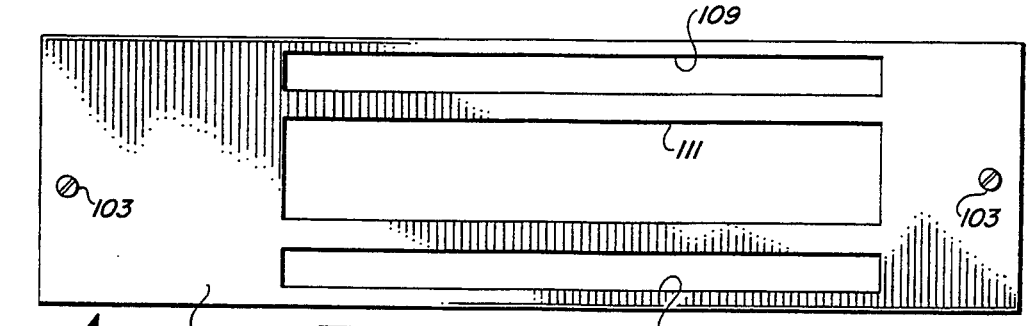
FIG. 7 is a top plan view of an electromagnet housing cover constructed according to the preferred embodiment of the present invention, which electromagnet housing cover will enclose the interior of the electromagnet housing member illustrated in FIGS. 4 through 6, showing the three slots through which the three ends of the E-shaped electromagnet core laminations best illustrated in FIGS. 1 and 3 will extend.

Referring now to FIGS. 4 through 6, an electromagnet housing member 64 is illustrated which embodies the preferred embodiment of the present invention. The electromagnet housing member 64 is essentially U-shaped, with side walls 66 and 68 extending from a flat base 70 (as best shown in FIG. 6). The side wall 68 will be located close adjacent the frame of a door (not shown), while the side wall 66 will be located away from the door frame. It will be noted that the electromagnet housing member 64 is constructed with an open top and open ends.

The interior of the electromagnet housing member 64, which is defined by and between the side walls 66 and 68 and the base 70, is sized to snugly fit the electromagnet core 50 (FIGS. 1 through 3), with the tops of the legs of the electromagnet core laminations 40 being approximately level with the tops of the side walls 66 and 68 of the electromagnet housing member 64 when the electromagnet core 50 is installed into the electromagnet housing member 64. It will be noted that the electromagnet housing member 64 is somewhat longer than the electromagnet core 50, for reasons that will later become apparent.

The interior walls of the side walls 66 and 68 each have a longitudinally extending notch located therein. The side wall 66 has a notch 72 located at the top and inside thereof, and the side wall 68 has a notch 74 located at the top and inside thereof. The purposes of the notches 72 and 74 is to receive a cover, as will become apparent below in conjunction with the discussion of FIGS. 7 through 10.

Referring now to FIGS. 4 and 6, note that the base 70 of the electromagnet housing member 64 extends beyond the outer side of the side wall 68. A short engaging segment 76 projects upwardly from the base 70 parallel to, and spaced away from, the side wall 68. Note that the engaging segment 76 is much shorter than is the side wall 68. The engaging segment 76 and the portion of the base 70 which extends beyond the side wall 68 together form an L-shaped projection which will be used to engage a mounting plate (not shown) mounted on the door frame (also not shown).

There are a variety of apertures located in the sides of the electromagnet housing member 64, as best illustrated in FIGS. 4 and 5. With one exception, which will be noted below, the apertures in the side walls 66 and 68 are identical. There are two countersunk apertures 78 and 80 located in the side of the side wall 68, as shown in FIG. 4. The countersunk apertures 78 and 80 are located slightly above the top side of the base 70 (FIG. 6), with the countersunk sides being located on the outer side of the side wall 68. The countersunk apertures 78 and 80 are spaced longitudinally apart, and as a pair are located somewhat closer to the end of the electromagnet housing member 64 shown on the right in FIG. 4.

The other side of the electromagnet housing member 64, illustrated in FIG. 5, has two additional countersunk apertures 82 and 84 located therein. The countersunk apertures 82 and 84 are coaxial with the countersunk apertures 78 and 80, respectively. The countersunk sides of the countersunk apertures 78 and 80 are located on the outer side of the side wall 66.

Due to the location of the countersunk apertures 78 and 80 in the side wall 68, arcuate notches 86 and 88 are necessary in the engaging segment 76, shown in FIG. 4. An arcuate notch 86 is located in the portion of the engaging segment 76 in front of the countersunk aperture 78. Similarly, an arcuate notch 88 is located in the portion of the engaging segment 76 in front of the countersunk aperture 80.

Two additional countersunk apertures are located in each of the side walls 66 and 68 for use in attaching an electromagnet housing cover (not shown) to the electromagnet housing member 64. These countersunk apertures are located near the tops and ends of the side walls 66 and 68. A countersunk aperture 90 is located near the top and near the left end of the side wall 68 as shown in FIG. 4; a countersunk aperture 92 is located near the top and near the right end of the side wall 68 as shown in FIG. 4. The countersunk sides of the countersunk apertures 90 and 92 are located on the outer side of the side wall 68.

Similarly, a countersunk aperture 94 is located near the top and near the right end of the side wall 66 as shown in FIG. 5; a countersunk aperture 96 is located near the top and near the left end of the side wall 66 as shown in FIG. 5. The countersunk sides of the countersunk apertures 94 and 96 are located on the outer side of the side wall 66.

Two additional apertures are located in the side wall 68 directly below the countersunk apertures 90 and 92. Similarly, two additional apertures are located in the side wall 66 below the countersunk apertures 94 and 96. These apertures will be used for mounting the electromagnet housing member 64 to the mounting plate (not shown).

Specifically, an aperture 98 is located in the side wall 68 below the countersunk aperture 90, and an aperture 100 is located in the side wall 68 below the countersunk aperture 92. The apertures 98 and 100 are thus both approximately centrally located near the ends of the side wall 68. Similarly, an aperture 102 is located in the side wall 66 below the countersunk aperture 94, and an aperture 104 is located in the side wall 66 below the countersunk aperture 96. The apertures 102 and 104 are thus both approximately centrally located near the ends of the side wall 66.

One additional aperture exists in the side wall 68, with no corresponding aperture in the side wall 66. A large aperture 106 is located in the side wall 68 to the right of the countersunk aperture 90 and the aperture 98 as seen in FIG. 4. The aperture 106 will be used to duct the wires from the electromagnet coil winding (not shown) out of the electromagnet housing member 64.

Referring next to FIGS. 7 through 10, an electromagnet housing cover 110 is illustrated which embodies the preferred embodiment of the present invention. The electromagnet housing cover 110 consists of three segments, the first of which is a thin cover plate 112 which is sized to fit precisely in the notches 72 and 74 in the side walls 66 and 68, respectively, of 64 (FIGS. 4 through 6). Cover 110 can be secured to members 114 & 116 by any suitable means, such as screws 103. When installed the cover plate 112 will be flush atop the electromagnet housing member 64, and will extend the entire length of the electromagnet housing member 64.

Located in the surface of the cover plate 112 are three slots 109, 111, and 113, which are placed to align with the tops of the three legs of the "E" formed by the electromagnet core laminations 40 of the electromagnet core 50 (FIGS. 1 and 3). The slots 109, 111, and 113 are sufficiently large to allow the three legs of the "E" formed by the electromagnet core laminations 40 of the electromagnet core 50 to extend therethrough. When the electromagnet core 50 is installed in the electromagnet housing member 64 (FIGS. 4 through 6) and the cover plate 112 is installed on the electromagnet housing member 64, the three legs of the "E" formed by the electromagnet core laminations 40 of the electromagnet core 50 will extend through the slots 109, 111, and 113 to an essentially flush position with respect to the top surface of the cover plate 112 (or, alternately, just beyond the top surface of the cover plate 112).

Figure 8:
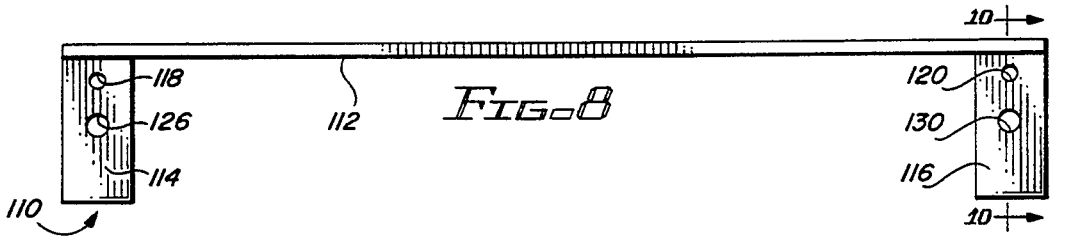
FIG. 8 is a side view of the electromagnet housing cover illustrated in FIG. 7, showing the apertures located in the end walls of the electromagnet housing cover which will be oriented toward the door frame member (not shown)
Figure 9:
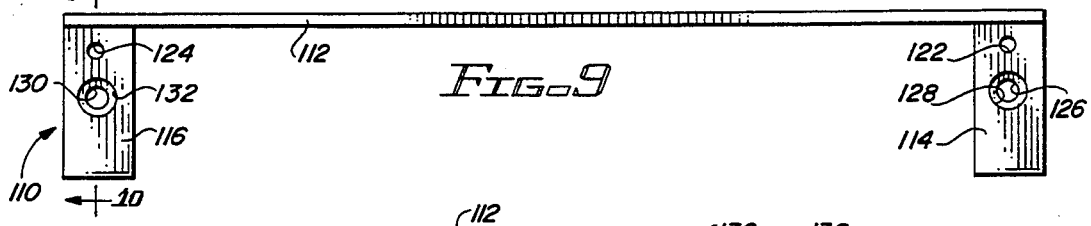
FIG. 9 is another side view of the electromagnet housing cover illustrated in FIGS. 7 and 8, showing the apertures located in the end walls of the electromagnet housing cover which will be oriented away from the door frame member (not shown)

The other two segments of the electromagnet housing cover 110 are end walls 114 and 116, which together with the cover plate 112 define a rather wide "U", as best seen in an inverted position in FIGS. 8 and 9. Thus, the legs of the "U" are the end walls 114 and 116, and the base of the "U" is the cover plate 112. Unlike the rather thin cover plate 112, the end walls 114 and 116 are relatively thick, which is necessary due to the size of the apertures contained in the end walls 114 and 116. When the electromagnet housing cover 110 is placed on the electromagnet housing member 64 (FIGS. 4 through 6), the end walls 114 and 116 will completely enclose the ends of the U-shaped channel formed by the side walls 66 and 68 and the base 70 of the electromagnet housing member 64.

Each of the end walls 114 and 116 has a pair of drilled and tapped apertures therein. The end wall 114 has an aperture 118 drilled and tapped near the top in one side thereof, and an aperture 122 drilled and tapped near the top in the other side thereof. Similarly, the end wall 116 has an aperture 120 drilled and tapped near the top in one side thereof, and an aperture 124 drilled and tapped near the top in the other side thereof. When the electromagnet housing cover 110 is placed in position on the electromagnet housing member 64 (FIGS. 4 through 6), the countersunk apertures 90, 92, 94, and 96 in the electromagnet housing member 64 will be aligned with the tapped apertures 118, 120, 122, and 124, respectively.

Each of the end walls 114 and 116 also has a pair of different size apertures located therein and originating from opposite sides of the end walls 114 and 116. The end wall 114 has an aperture 126 located therein below the tapped aperture 118 on one side thereof, and an aperture 128 located therein below the tapped aperture 122 on the other end thereof. The apertures 126 and 128 are coaxial and in communication with each other, and the aperture 128 is considerably larger in diameter than is the aperture 126. When the electromagnet housing cover 110 is placed in position on the electromagnet housing member 64 (FIGS. 4 through 6), the apertures 126 and 128 will be respectively aligned and coaxial with the apertures 98 and 102.

Similarly, the end wall 116 has an aperture 130 located therein below the tapped aperture 120 on one side thereof, and an aperture 132 located therein below the tapped aperture 124 on the other end thereof. The apertures 130 and 132 are coaxial and in communication with each other, and the aperture 132 is considerably larger in diameter than is the aperture 130. When the electromagnet housing cover 110 is placed in position on the electromagnet housing member 64 (FIGS. 4 through 6), the apertures 130 and 132 will be respectively aligned and coaxial with the apertures 100 and 104.

Figure 10:
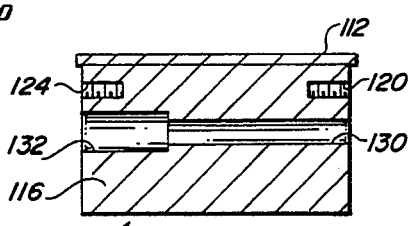
FIG. 10 is a cross-sectional view of the electromagnet housing cover illustrated in FIGS. 7 through 9, showing the aperture extending through one of the end walls of the electromagnet housing cover, which aperture will contain a mounting bolt therein.

Note that as shown in FIG. 10, the larger aperture 132 does not extend into the end wall 116 as far as does the smaller aperture 130. The same relationship is true of the apertures 126 and 128 in the end wall 114. The purpose of the depth of the larger apertures 128 and 132 will become apparent immediately below, in conjunction with the discussion of FIG. 11.

Figure 11:
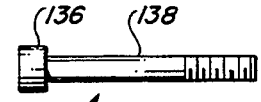
FIG. 11 is a side plan view of a mounting bolt which will be contained in the aperture extending through one of the end walls of the electromagnet housing cover and illustrated in FIG. 10.

Referring now to FIG. 11, one of two identical mounting bolts 134 used in the preferred embodiment is illustrated which has a head 136 and a shaft 138, at least the distal end of which shaft 138 is threaded. The mounting bolts 130 may, in the preferred embodiment, have an Allen head or a Torx head. The shaft 138 of the mounting bolts 134 is smaller in diameter than the diameter of the apertures 126 and 130 (FIGS. 9 and 10) of the electromagnet housing cover 110. The shaft 138 of the mounting bolts 134 is also smaller in diameter than the diameters of the apertures 98 and 100 (FIG. 4) of the electromagnet housing member 64.

The head 136 of the mounting bolts 134 is smaller in diameter than the diameters of the apertures 128 and 132 (FIGS. 9 and 10) of the electromagnet housing cover 110. The head 136 of the mounting bolts 134 is, however, larger in diameter than the diameters of the apertures 102 and 104 (FIG. 5) of the electromagnet housing member 64.

The length of the mounting bolts 134 is just less than the width of the end wall 114 (equal to the combined lengths of the apertures 126 and 128) and the width of the end wall 116 (equal to the combined lengths of the apertures 130 and 132). Thus, the mounting bolts 134 will fit wholly within the end walls 114 and 116 of the electromagnet housing cover 110 (FIGS. 9 and 10). The depth of the larger apertures 128 and 132 is sufficient to allow the mounting bolt 134 to extend through the apertures 98 or 100 in the electromagnet housing member 64 (FIG. 4) sufficiently far to engage the mounting plate (not shown). Since the apertures 102 and 104 of the electromagnet housing member 64 are smaller than the head 136 of the mounting bolts 134, the mounting bolts 134 will be retained in the end walls 114 and 116, allowing access by the above-mentioned tool.

Figure 12:
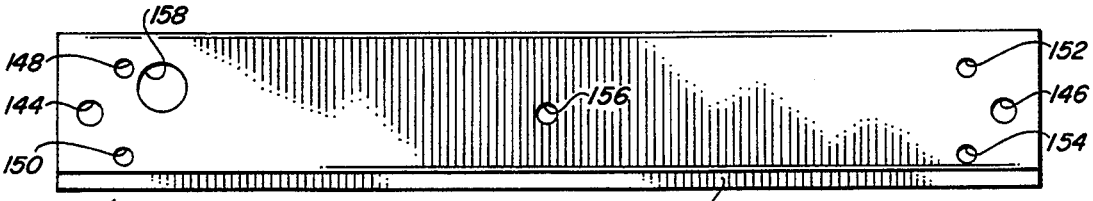
FIG. 12 is a plan view of a mounting plate constructed according to the preferred embodiment of the present invention, showing the side of the mounting plate which will be placed adjacent the door frame member (not shown)
Figure 13:
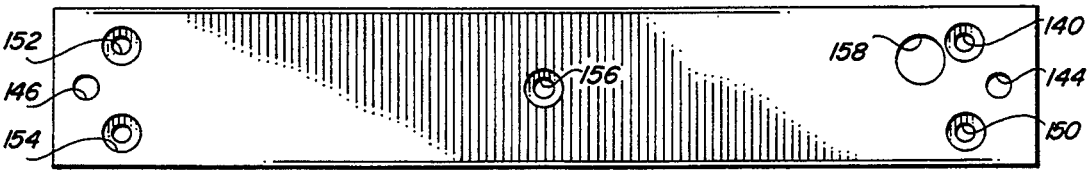
FIG. 13 is another plan view of the mounting plate illustrated in FIG. 12, showing the side of the mounting plate which will be oriented away from the door frame member (not shown)
Figure 14:
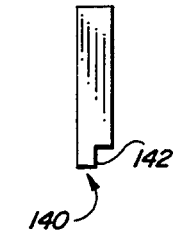
FIG. 14 is an end view of the mounting plate illustrated in FIGS. 12 and 13, showing the cross-sectional configuration of the mounting plate, including the engaging member which will engage the engaging member of the electromagnet housing member illustrated in FIG. 6.

Referring next to FIGS. 12 through 14, a mounting plate 140 is illustrated which embodies the preferred embodiment of the present invention. The mounting plate 140 has an engaging notch 142 cut into one side thereof at the bottom thereof, as best shown in FIGS. 12 and 14. The mounting plate 140 is designed to fit adjacent to the outer side of the side wall 68 of the electromagnet housing member 64 (FIGS. 4 and 6), with the engaging notch 142 engaged by the engaging segment 76. As such, the side of the mounting plate 140 illustrated in FIG. 13 will be in facial contact with the outer side of the side wall 68. The length and width of the mounting plate 140 is, in the preferred embodiment, approximately identical to the length and height of the side wall 68.

The mounting plate 140 has a pair of drilled and tapped apertures therein, which are centrally located near the ends of the mounting plate 140. A tapped aperture 144 is located at one end, and a tapped aperture 146 is located at the other end. When the mounting plate 140 is engaged with the electromagnet housing member 64 (FIGS. 4 and 6), the tapped apertures 144 and 146 in the mounting plate 140 will be respectively aligned with the apertures 98 and 100 in the electromagnet housing member 64. The threaded distal ends of the shafts 138 of the mounting bolts 134 will engage the tapped apertures 144 and 146 to secure the electromagnet housing member 64 to the mounting plate 140.

Also located in the mounting plate 140 are five countersunk apertures 148, 150, 152, 154, and 156, all of which are countersunk on the side of the mounting plate 140 which will face toward the outer side of the side wall 68 of the electromagnet housing member 64 (FIGS. 4 and 6). Two of the countersunk apertures 148 and 150 are located relatively near the right end of the mounting plate 140 as shown in FIG. 13, near the top and bottom of the mounting plate 140, respectively.

Two more of the countersunk apertures 152 and 154 are located relatively near the left end of the mounting plate 140 as shown in FIG. 13, near the top and bottom of the mounting plate 140, respectively. The last countersunk aperture 156 is centrally located in the mounting plate 140. The countersunk apertures 148, 150, 152, 154, and 156 will be used to secure the mounting plate 140 to the door frame (not shown). A large aperture 158 is located in the mounting plate 140 to the right of the countersunk aperture 148 and the tapped aperture 144 as seen in FIG. 12. The aperture 158 will be aligned with the aperture 106 in the electromagnet housing member 64 (FIG. 4), and like the aperture 106 will be used to duct the wires from the electromagnet coil winding (not shown) out of the electromagnet housing member 64.

Figure 15:
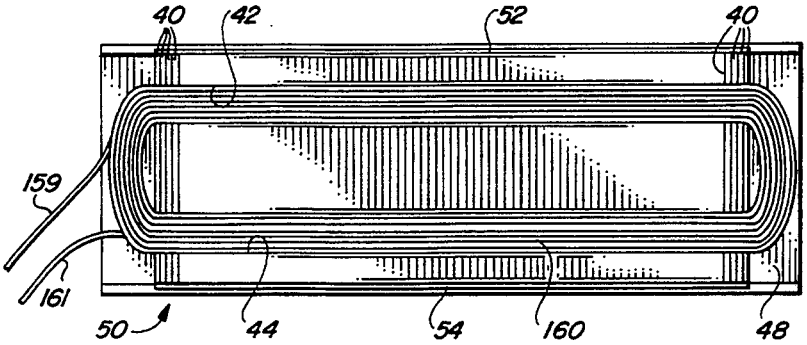
FIG. 15 is a plan view of an electromagnet assembly consisting of the electromagnet core illustrated in FIGS. 1 through 3, with an electromagnet coil winding installed thereon.

The final assembly and installation of the electromagnet coil assembly of the present invention may now be described. Referring first to FIG. 15, an electromagnet coil winding 160 having wires 159 and 161 extending therefrom is shown in place on the electromagnet Core 50 (FIGS. 1 through 3), thereby completing the assembly of an electromagnet assembly 162.

Figure 16:
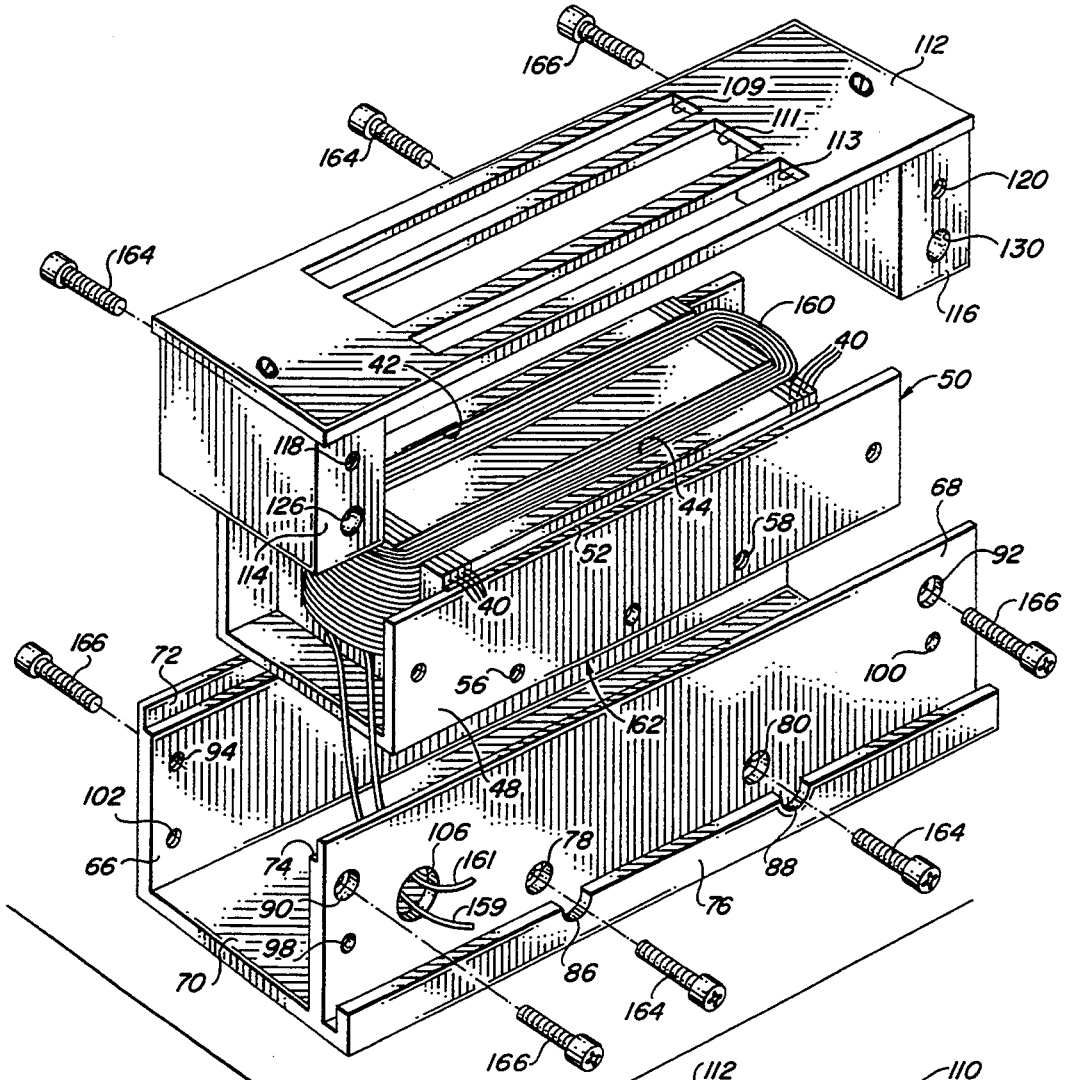
FIG. 16 is an isometric view illustrating the installation of the electromagnet assembly illustrated in FIG. 15 into the electromagnet housing member illustrated in FIGS. 4 through 6, and the installation of the electromagnet housing cover illustrated in FIGS. 7 through 10 (containing two of the mounting bolts illustrated in FIG. 11 (which are not shown in FIG. 16) onto the electromagnet housing member.

Referring next to FIG. 16, the assembly of the electromagnet assembly 162 into the electromagnet housing member 64, and the subsequent closing of the electromagnet housing member 64 using the electromagnet housing cover 110, is illustrated. The electromagnet assembly 162 is inserted into the interior of the electromagnet housing member 64, between the side walls 66 and 68. The bottom of the U-shaped channel member 48 of the electromagnet assembly 162 is placed on the interior surface of the base 70 of the electromagnet housing member 64.

Four flat-head bolts 164 are used to retain the electromagnet assembly 162 in place in the electromagnet housing member 64. A first bolt 164 is inserted through the countersunk aperture 78 in the electromagnet housing member 64 and into the tapped aperture 56 in the electromagnet core 50. A second bolt 164 is inserted through the countersunk aperture 80 in the electromagnet housing member 64 and into the tapped aperture 58 in the electromagnet core 50. A third bolt 164 is inserted through the countersunk aperture 82 in the electromagnet housing member 64 and into the tapped aperture 60 (not shown) in the electromagnet core 50. A fourth bolt 164 is inserted through the countersunk aperture 84 in the electromagnet housing member 64 and into the tapped aperture 62 (not shown) in the electromagnet core 50.

Prior to installation of the electromagnet housing cover 110 onto the electromagnet housing member 64, the mounting bolts 134 (not visible in FIG. 16) are placed into the apertures 128 and 126 in the end wall 114 and the apertures 132 and 130 in the end wall 116.

The electromagnet housing cover 110 is then placed on the electromagnet housing member 64. In this position, the cover plate 112 of the electromagnet housing cover 110 will rest on the notches 72 and 74 in the electromagnet housing member 64. In addition, the end walls 114 and 116 of the electromagnet housing cover 110 will cover the ends of the electromagnet housing member 64 between the side walls 66 and 68 and the base 70. The three legs of the "W" formed by the slot 44 of the electromagnet core 50 will extend through the three slots 109, 111, and 113 in the cover plate 112 of the electromagnet housing cover 110.

In addition, the aperture 126 in the electromagnet housing cover 110 is aligned with the aperture 98 in the electromagnet housing member 64, and the aperture 130 in the electromagnet housing cover 110 is aligned with the aperture 100 in the electromagnet housing member 64. Also, the aperture 128 in the electromagnet housing cover 110 is axially aligned with the aperture 102 in the electromagnet housing member 64, and the aperture 132 in the electromagnet housing cover 110 is axially aligned with the aperture 104 in the electromagnet housing member 64.

Four flat-head bolts 166 are used to retain the electromagnet housing cover 110 in place on the electromagnet housing member 64. A first bolt 166 is inserted through the countersunk aperture 90 in the electromagnet housing member 64 and into the tapped aperture 118 in the cover plate 112. A second bolt 166 is inserted through the countersunk aperture 92 in the electromagnet housing member 64 and into the tapped aperture 120 in the cover plate 112. A third bolt 166 is inserted through the countersunk aperture 94 in the electromagnet housing member 64 and into the tapped aperture 122 in the cover plate 112. A fourth bolt 166 is inserted through the countersunk aperture 96 in the electromagnet housing member 64 and into the tapped aperture 124 in the cover plate 112.

Figure 17:
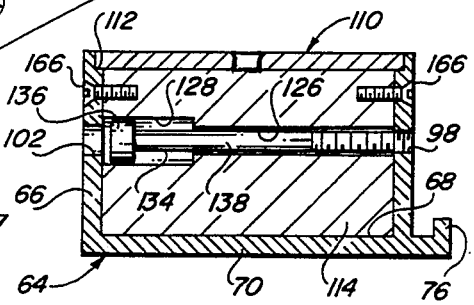
FIG. 17 is a cross-sectional view of the assembly of FIG. 16, showing the position of the mounting bolt within the aperture contained in one of the end walls of the electromagnet housing cover.

Referring next to FIG. 17, the position of one of the mounting bolts 134 is illustrated within the end wall 114 of the electromagnet housing cower 110. Note that since the diameter of the head 136 of the mounting bolt 134 is larger than the diameter of the aperture 102 in the electromagnet housing member 64, the mounting bolt 134 may not come out of its position within the end wall 114 of the electromagnet housing cover 110. However, it will be appreciated that the mounting bolt 134 can move axially to the right of the position in which it is illustrated in FIG. 17. As the mounting bolt 134 moves to the right, the threaded end of the shaft 138 of the mounting bolt 134 will extend well through the aperture 98 in the electromagnet housing member 64.

Figure 18:
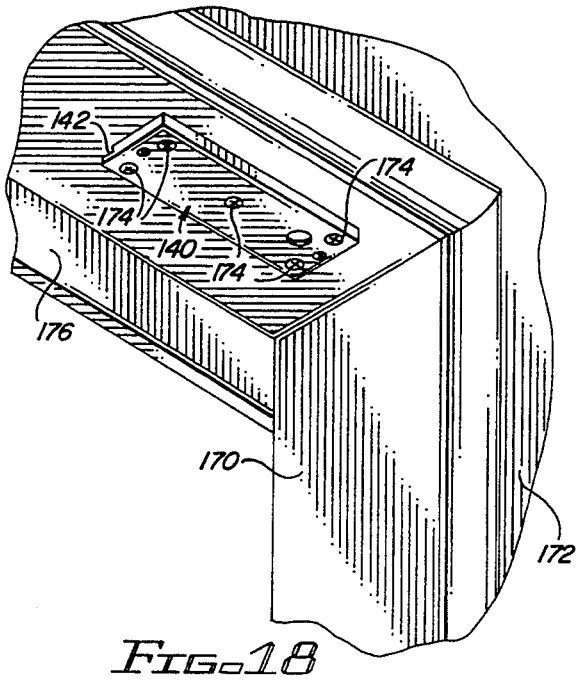
FIG. 18 is an isometric view of a part of the top portion of the frame of a door, showing the installation of the mounting plate illustrated in FIGS. 12 through 14 onto the bottom of the top portion of the door frame.

Moving now to FIG. 18, a portion of a door frame 170 mounted in a wall 172 is illustrated. The mounting plate 140 is installed in the underside of the top of the door frame 170 using five flat-head screws 174 inserted through the countersunk apertures 148, 150, 152, 154, and 156. Note that the mounting plate 140 is mounted with the engaging notch 142 located facing the underside of the top of the door frame 170. Note also that the engaging notch 142 faces away from the door (not shown) will be when it closes.

Finally, note that the side of the mounting plate 140 having the engaging notch 142 thereon is spaced slightly away from a back support portion 176 of the door frame 170. This last aspect is necessary to allow the engaging portions of the electromagnet housing member 64, which are the base 70 and the engaging segment 76 (shown in FIG. 6), to fit between the back support portion 176 of the door frame 170 and the side of the mounting plate 140 having the engaging notch 142 thereon.

Figure 19:
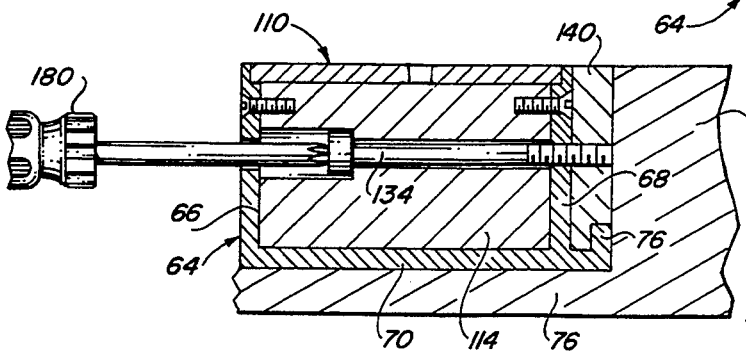
FIG. 19 is a cross-sectional view similar to that shown in FIG. 17, showing the electromagnet housing in engagement with the mounting plate on the door frame (which frame is shown rotated clockwise 90 degrees in the view of FIG. 19), with one of the mounting bolts being screwed into the mounting plate with a tool.

Referring next to FIG. 19, note that the apparatus of FIG. 16 is installed onto the mounting plate 140 by sliding it so that the engaging notch 142 of the mounting plate 140 engages the engaging segment 76 of the electromagnet housing member 64. When it is in the installed position, the aperture 98 of the electromagnet housing member 64 will be aligned with the tapped aperture 144 of the mounting plate 140, and the aperture 100 of the electromagnet housing member 64 will be aligned with the tapped aperture 146 of the mounting plate 140.

Figure 20:
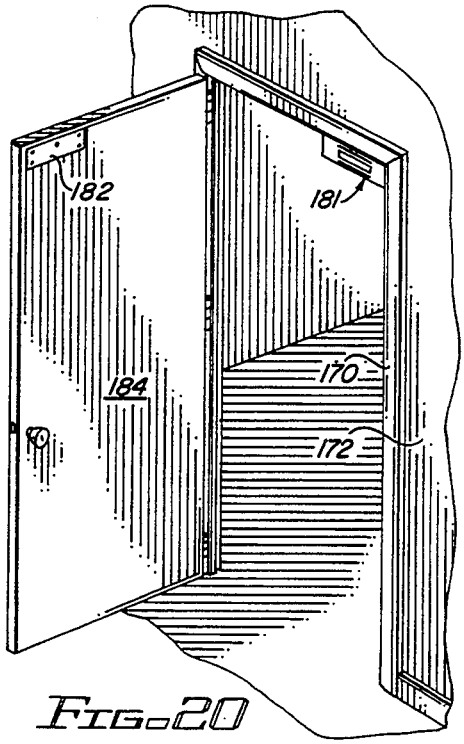
FIG. 20 is an isometric view showing the apparatus of the preferred embodiment of the present invention installed onto the door frame, with an electromagnet armature being shown installed on a door for engagement with the electromagnet.

At this point, a tool 180 may be used to advance the mounting bolts 134 into engagement with the tapped apertures 144 and 146 of the mounting plate 140. Note that final installation and removal of the apparatus 181 of the present invention is accomplished with only two mounting bolts 134. The completed installation is illustrated in FIG. 20, which also shows an armature plate 182 mounted onto a door 184. The armature plate 182 is of course retained by the electromagnet in the apparatus 181 when the electromagnet is energized, thereby retaining the door 184 in the closed position.

An alternate embodiment using much the same principles is illustrated in FIGS. 21 through 30. FIGS. 21 through 25 illustrate the alternate embodiment electromagnet housing member 200, which is made of heavy gauge, pan-bent sheet metal of approximately one-sixteenth inch thickness. The electromagnet housing member 200 consists essentially of a box member 202 which is open on the top. The box member 202 has its corners welded together.

Figure 22:
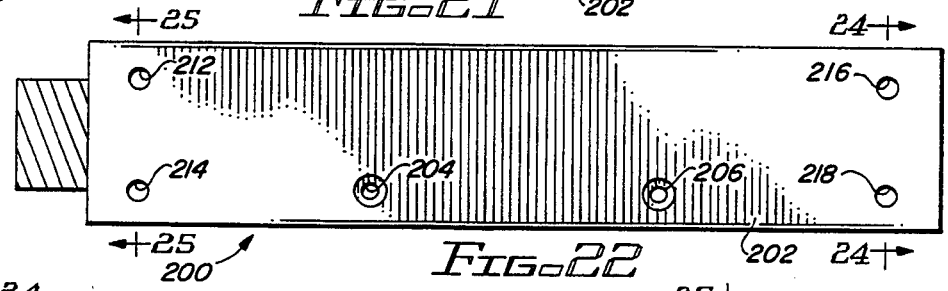
FIG. 22 is a side view of the electromagnet housing member illustrated in FIG. 21, showing the various apertures in the side of the electromagnet housing member which will be oriented away from the door frame member (not shown in FIG. 22)

The box member 202 has two countersunk apertures 204 and 206 located in the side of the box member 202 illustrated in FIG. 22. The countersunk apertures 204 and 206 are located slightly above the bottom of the box member 202, with the countersunk sides being located on the outside of the box member 202. The countersunk apertures 204 and 206 are spaced longitudinally apart, and as a pair are located essentially centrally on the side of the box member 202 illustrated in FIG. 22.

Figure 23:
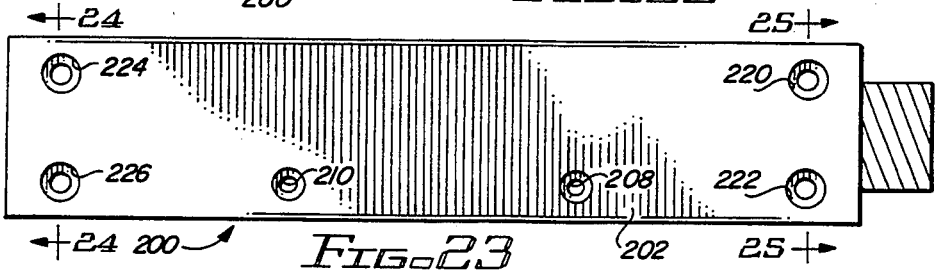
FIG. 23 is another side view of the electromagnet housing member illustrated in FIG. 21 and 22, showing the various apertures in the side of the electromagnet housing men, her which will be oriented toward the door frame member (not shown in FIG. 23)

The box member 202 has two additional countersunk apertures 208 and 210 located in the other side of the box member 202, which is illustrated in FIG. 23. The countersunk apertures 208 and 210 are also located slightly above the bottom of the box member 202, with the countersunk sides again being located on the outside of the box member 202. The countersunk apertures 208 and 210 are spaced longitudinally apart, and as a pair are located essentially centrally on the side of the box member 202 illustrated in FIG. 23, thus paralleling the countersunk apertures 204 and 206, respectively, on the Side of the box member 202 illustrated in FIG. 22.

The countersunk apertures 204, 206, 208, and 210 are used to secure the electromagnet core 50 (FIG. 15), in the same manner as the countersunk apertures 78, 80, 82, and 84 are used in the electromagnet housing member 64 (FIGS. 4 and 5).

There are four additional apertures located on each side of the box member 202. The four apertures on the side of the box member 202 illustrated in FIG. 22 are the same size as the size of the apertures 98 and 100 on the electromagnet housing member 64 (FIG. 4). The four apertures on the other side of the box member 202 illustrated in FIG. 23, on the other hand, are sufficiently large to admit the head 136 of the mounting bolt 134 (FIG. 11). The electromagnet housing member 200 thus is unlike the electromagnet housing member 64 in that it is not designed to retain the mounting bolts 134, although it easily could be adapted to do so by making the apertures on the other side of the box member 202 illustrated in FIG. 23 smaller in diameter.

Four apertures 212, 214, 216, and 218 are located on the side of the box member 202 illustrated in FIG. 22. The aperture 212 is located near the top and left of the side of the box member as illustrated in FIG. 22. The aperture 214 is located near the bottom and left of the side of the box member as illustrated in FIG. 22. The aperture 216 is located near the top and right of the side of the box member as illustrated in FIG. 22. The aperture 218 is located near the bottom and right of the side of the box member as illustrated in FIG. 22.

Four apertures 220, 222, 224, and 226 are located on the other side of the box member 202 illustrated in FIG. 23. The aperture 220 is located near the top and right of the side of the box member as illustrated in FIG. 23. The aperture 222 is located near the bottom and right of the side of the box member as illustrated in FIG. 23. The aperture 224 is located near the top and left of the side of the box member as illustrated in FIG. 23. The aperture 226 is located near the bottom and left of the side of the box member as illustrated in FIG. 23.

Figure 25:
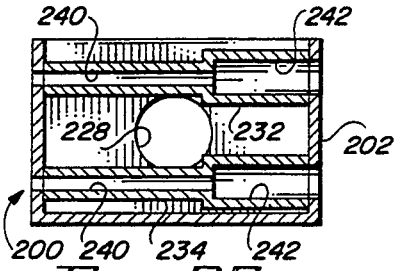
FIG. 25 is another cross-sectional view near the other end of the electromagnet housing member illustrated in FIGS. 21 through 24, showing two of the cylindrical inserts and the apertures therein for holding mounting bolts (not shown in FIG. 25)

A large aperture 228 is located at one end of the box member 202, as best shown in FIG. 25. A threaded, cylindrical member 230 is welded onto the outside of the box member 202, as best seem in FIGS. 21 through 23. The wires 159 and 161 from the electromagnet coil winding 160 (FIG. 15) will exit the electromagnet housing member 200 through the aperture 228 and the threaded, cylindrical member 230.

Figure 21:
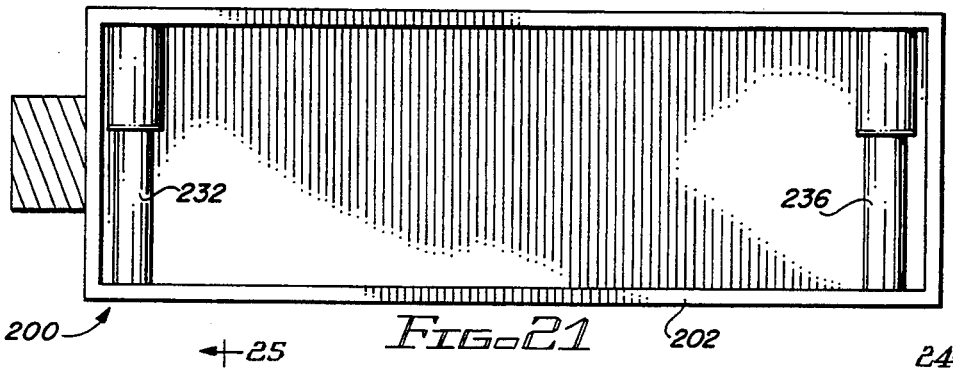
FIG. 21 is a plan view of an alternate embodiment electromagnet housing member, showing two of the cylindrical inserts which contain apertures (not shown in FIG. 21) for holding mounting bolts (not shown in FIG. 21)
Figure 24:
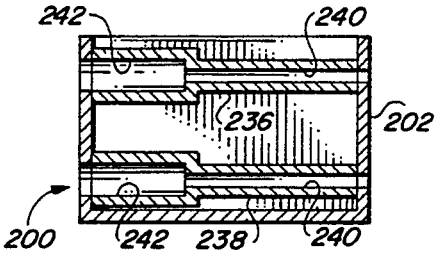
FIG. 24 is a cross-sectional view near one end of the electromagnet housing member illustrated in FIGS. 21 through 23, showing two of the cylindrical inserts and the apertures therein for holding mounting bolts (not shown in FIG. 24)

Four cylindrical members 232, 234, 236, and 238 are used within the box member 202 to facilitate installation of the mounting bolts 134 (FIG. 11). The cylindrical members 232, 234, 236, and 238 are best shown in FIGS. 21, 24, and 25, and each has two internal diameters. Each of the cylindrical members 232, 234, 236, and 238 has a smaller internal diameter 240 at one end thereof, and a larger internal diameter 242 at the other 22end thereof. The internal diameters 240 and 242 of each of the cylindrical members 232, 234, 236, and 238 are coaxial, and in communication with each other.

The cylindrical members 232, 234, 236, and 238 extend within the box member 202 between the two side walls of the box member 202, and each is in, communication with an aperture located in each of the side walls of the box member 202. The cylindrical members 232, 234, 236, and 238 are welded in place inside the box member 202.

The cylindrical member 232 extends between the side walls of the box member 202, with the aperture 212 of the box member 202 being in communication with the smaller internal diameter 240 of the cylindrical member 232, and with the aperture 220 of the box member 202 being in communication with the larger internal diameter 242 of the cylindrical member 232. The cylindrical member 234 extends between the side walls of the box member 202, with the aperture 214 of the box member 202 being in communication with the smaller internal diameter 240 of the cylindrical member 234, and with the aperture 222 of the box member 202 being in communication with the larger internal diameter 242 of the cylindrical member 234.

The cylindrical member 236 extends between the side walls of the box member 202, with the aperture 216 of the box member 202 being in communication with the smaller internal diameter 240 of the cylindrical member 236, and with the aperture 224 of the box member 202 being in communication with the larger internal diameter 242 of the cylindrical member 236. The cylindrical member 238 extends between the side walls of the box member 202, with the aperture 218 of the box member 202 being in communication with the smaller internal diameter 240 of the cylindrical member 238, and with the aperture 226 of the box member 202 being in communication with the larger internal diameter 242 of the cylindrical member 238.

Figure 26:
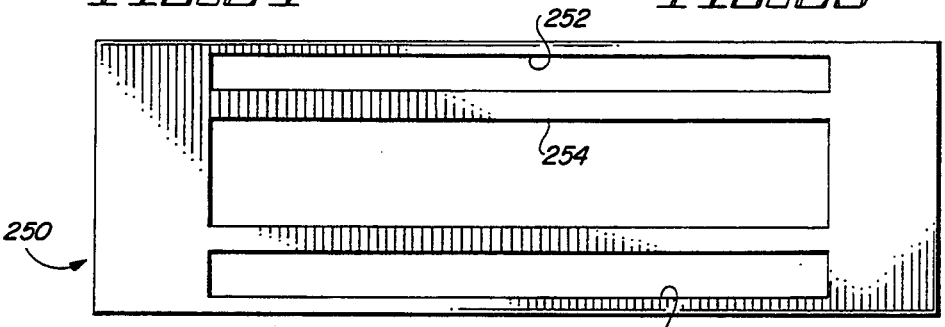
FIG. 26 is a top plan view of an alternate embodiment electromagnet housing cover, which electromagnet housing cover will enclose the interior of the electromagnet housing member illustrated in FIGS. 21 through 25, showing the three slots through which the three ends of the E-shaped electromagnet core laminations best illustrated in FIGS. 1 and 3 will extend.
Figure 27:
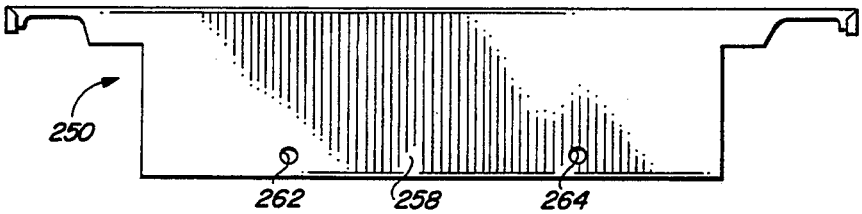
FIG. 27 is a side view of the electromagnet housing cover illustrated in FIG. 26, showing the apertures in the sides of the electromagnetic housing cover which will retain the electromagnet housing cover in position on the electromagnet housing member illustrated in FIGS. 21 through 25.
Figure 28:
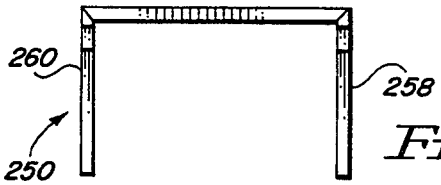
FIG. 28 is an end view of the electromagnet housing cover illustrated in FIG. 26 and 27.

Referring next to FIGS. 26 through 28, an electromagnet housing cover 250 also made of pan-bent sheet metal is illustrated. The top surface of the electromagnet housing cover 250, illustrated in FIG. 26, has three slots 252, 254, and 256, which are located to align with the tops of the three legs of the "E" formed by the electromagnet core laminations 40 of the electromagnet core 50 (FIGS. 1 and 3). The slots 252, 254, and 256 are sufficiently large to allow the three legs of the "E" formed by the electromagnet core laminations 40 of the electromagnet core 50 to extend therethrough. When the electromagnet core 50 is installed in the electromagnet housing member 200 (FIGS. 21 through 25) and the cover plate 250 is installed on the electromagnet housing member 200, the three legs of the "E" formed by the electromagnet core laminations 40 of the electromagnet core 50 will extend through the slots 252, 254, and 256 to an essentially flush position with respect to the top surface of the electromagnet housing cover 250 (or, alternately, just beyond the top surface of the electromagnet housing cover 250).

The lateral sides of the electromagnet housing cover 250 are quite short, as best illustrated in FIGS. 27 and 28. The longitudinal sides of the electromagnet housing cover 250 are longer, except for the portions which would otherwise interfere with the cylindrical members 232, 234, 236, and 238 (FIGS. 21, 24, and 25). These longer sides are designated by the reference numerals 258 and 260.

Located in each of the two sides 258 and 260 are two apertures, which will be used to retain the electromagnet housing cover 250 in place on the electromagnet housing member 200 (FIGS. 21 through 25). Two apertures 262 and 264 are located slightly above the bottom edge of the side 258. The apertures 262 and 264 are spaced longitudinally apart, and as a pair are located essentially centrally on the side 258 of the electromagnet housing cover 250, as illustrated in FIG. 27.

Similarly located, although they are not shown, are two apertures 266 and 268, which are located slightly above the bottom edge of the side 260. The apertures 266 and 268 are spaced longitudinally apart as are the apertures 262 and 264 in the side 258, and as a pair the apertures 266 and 268 are located essentially centrally on the side 260 of the electromagnet housing cover 250.

Although the final assembly of the alternate embodiment electromagnet coil assembly is not illustrated in the figures, it is quite simple. Four flat-head bolts (not shown) would be used both to secure the electromagnet core 50 inside the electromagnet housing member 200, and at the same time to secure the electromagnet housing cover 250 in place on the electromagnet housing member 200.

A first flat-head bolt would be inserted through the countersunk aperture 204 in the electromagnet housing member 200, and then through the aperture 262 in the side 258 of the electromagnet housing cover 250, and finally into the tapped aperture 56 in the electromagnet core 50. A second flat-head bolt would be inserted through the countersunk aperture 206 in the electromagnet housing member 200, and then through the aperture 264 in the side 258 of the electromagnet housing cover 250, and finally into the tapped aperture 58 in the electromagnet core 50.

A third flat-head bolt would be inserted through the countersunk aperture 208 in the electromagnet housing member 200, and then through the aperture 266 (not shown) in the side 260 of the electromagnet housing cover 250, and finally into the tapped aperture 60 (not shown) in the electromagnet core 50. A fourth flat-head bolt would be inserted through the countersunk aperture 210 in the electromagnet housing member 200, and then through the aperture 268 (not shown) in the side 260 of the electromagnet housing cover 250, and finally into the tapped aperture 62 (not shown) in the electromagnet core 50.

Figure 29:
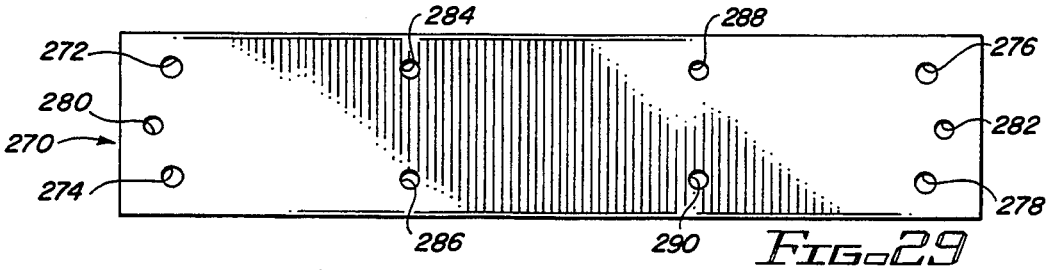
FIG. 29 is a plan view of an alternate embodiment mounting plate, showing the side of the mounting plate which will be placed adjacent the door frame member (not shown in FIG. 29)
Figure 30:
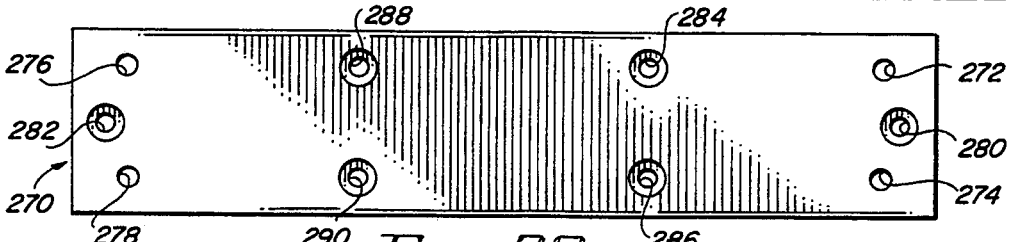
FIG. 30 is another plan view of the mounting plate illustrated in FIG. 29, showing the side of the mounting plate which will be oriented away from the door frame member (not shown in FIG. 30).

Turning finally to FIGS. 29 and 30, a mounting plate 270 is illustrated for use with the electromagnet housing member 200 (FIGS. 21 through 25). First, it should be noted that the electromagnet housing member 200 may be used without a mounting plate by drilling and tapping four holes in the proper pattern in the door frame (not shown). If a mounting plate is to be used with the electromagnet housing member 200, the mounting plate 270 is the proper one.

The mounting plate 270 has four drilled and tapped apertures therein, which are located near the ends of the mounting plate 270. A first tapped aperture 272 is located near the left end and near the top of the mounting plate 270 as illustrated in FIG. 29. A second tapped aperture 274 is located near the left end and near the bottom of the mounting plate 270 as illustrated in FIG. 29. A third tapped aperture 276 is located near the right end and near the top of the mounting plate 270 as illustrated in FIG. 29. A fourth tapped aperture 278 is located near the right end and near the bottom of the mounting plate 270 as illustrated in FIG. 29.

When the mounting plate 270 is engaged with the electromagnet housing member 200 (FIGS. 21 through 25), the tapped apertures 272, 274, 276 and 278 in the mounting plate 270 will be respectively aligned with the apertures 212, 214, 216, and 218 in the electromagnet housing member 200. The threaded distal ends of the shafts 138 of the mounting bolts 134 (FIG. 11) will engage the tapped apertures 272, 274, 276, and 278 to secure the electromagnet housing member 200 to the mounting plate 170.

Also located in the mounting plate 170 are six countersunk apertures 280, 282, 284, 286, 288, and 290, all of which are countersunk on the side of the mounting plate 170 which will face toward the electromagnet housing member 200 (FIGS. 21 through 25). One of the countersunk apertures 280 is centrally located relatively near the right end of the mounting plate 170 as shown in FIG. 30. Another of the countersunk apertures 282 is centrally located relatively near the left end of the mounting plate 170 as shown in FIG. 30.

Two more of the countersunk apertures 284 and 288 are located slightly below the top, edge of the mounting plate 170 as illustrated in FIG. 30. The countersunk apertures 284 and 288 are spaced longitudinally apart, and as a pair are located essentially centrally on the side of the mounting plate 270 as illustrated in FIG. 30. The last two countersunk apertures 286 and 290 are located slightly above the bottom edge of the mounting plate 170 as illustrated in FIG. 30. The countersunk apertures 286 and 290 are spaced longitudinally apart, and as a pair are located essentially centrally on the side of the mounting plate 270 as illustrated in FIG. 30.

This installation of the mounting plate 270 is essentially similar to the mounting of the mounting plate 140 described above, and thus further elaboration is not necessary. The balance of the installation is substantially similar to the installation of the preferred embodiment, and is also not elaborated upon here.

It may therefore be appreciated from the above detailed description of the preferred embodiment of the present invention that it teaches an improved design and related method of assembly for a laminated electromagnet core. The construction and design of the improved electromagnet core significantly enhance the manufacturability of the laminated electromagnet core, while simultaneously resulting in an electromagnet core assembly which exhibits excellent electrical and magnetic core characteristics. In addition, the improved design and related improved method of assembly of the present invention are simple to accomplish, and are also highly repeatable, thereby making the electromagnet cores produced consistent in both construction and performance.

The electromagnet core assembly of the present invention exhibits unparalleled ease of initial installation, both in terms of time required to install it and also in absolute simplicity of installation. In addition, replacement of the electromagnet core assembly is both simple and quick to accomplish, thereby making the electromagnet core assembly of the present invention easier to service than any other similar apparatus. The improved electromagnet core assembly utilizes modular assembly to enhance its serviceability, resulting in a lowering of overall costs involved in servicing the apparatus. Despite these advantages, the improved electromagnet core assembly of the present invention is tamper-resistant to at least as high a degree as the best of the previously known devices.

The electromagnet core assembly of the present invention is of a construction which is both durable and long lasting, and it also requires essentially no maintenance to be provided by the user, In order to enhance the market appeal of the apparatus of the electromagnet core assembly of the present invention, it is of relatively inexpensive construction to thereby afford it the broadest possible market. Finally, all of the aforesaid advantages and objectives of the electromagnet core assembly of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. An electromagnet coil assembly for use in an electrically operated security system used to magnetically secure an exit door hingedly mounted in a door frame, the exit door having secured to it a magnetically attractable armature that is adapted to be attracted to and held by said electromagnetic coil assembly, said electromagnet coil assembly comprising:

a U-shaped channel member;

a plurality of thin, flat electromagnet core laminations which electromagnet core laminations are stacked together to form an array of electromagnet core laminations, wherein said array of electromagnet core laminations are placed into said U-shaped channel member;

means for permanently retaining said array of electromagnet core laminations in fixed position within said U-shaped channel member;

an electromagnet coil winding mounted on said array of electromagnet core laminations whereby said U-shaped channel together with said array of electromagnet core laminations and said electromagnet coil winding form an electromagnet assembly;

an electromagnet housing member having an opening therein, said electromagnet assembly being fixedly mounted within said electromagnet housing member;

an electromagnet housing cover for installation onto said electromagnet housing member to close said opening in said electromagnet housing member, said electromagnet housing member and said electromagnet housing cover together comprising an electromagnet housing;

mounting bolts for installing said electromagnet housing onto the door frame, said mounting bolts having shafts and also having heads for driving said mounting bolts; and bolt retaining means located within said electromagnet housing for containing said mounting bolts therein, said bolt retaining means providing access to allow a tool to drivingly engage said mounting bolts to mount said electromagnet housing to the door frame without requiring any disassembly of said electromagnet housing.

2. An electromagnet coil assembly as defined in claim 1, wherein said electromagnet core laminations are E-shaped to thereby resemble a primitive "E", with three spaced-apart legs extending from a base, said array of electromagnet core laminations thereby forming a pair of slots between adjacent pairs of said legs.

3. An electromagnet coil assembly as defined in claim 2, wherein said electromagnet coil winding is installed around the intermediate one of said three legs of said electromagnet core laminations and into said pair of slots between adjacent pairs of said legs of said electromagnet core laminations.

4. An electromagnet coil assembly as defined in claim 2, wherein said electromagnet housing cover has three slots contained therein for allowing the ends of said legs of said electromagnet core laminations to extend therethrough.

5. An electromagnet coil assembly as defined in claim 1, wherein the legs of said U-shaped channel are shorter than the height of said electromagnet core laminations, said electromagnet core laminations thereby extending from the top of said U-shaped channel.

6. An electromagnet coil assembly as defined in claim 1, wherein thin weld beads secure the top edges of said U-shaped channel member to the sides of said electromagnet core laminations.

7. An electromagnet coil assembly as defined in claim 1, wherein said U-shaped channel is longer than said array of electromagnet core laminations.

8. An electromagnet coil assembly as defined in claim 1, additionally comprising:

a mounting plate for installation onto the door frame, said mounting plate having a plurality of drilled and tapped apertures therein for receiving the portion of said mounting bolts projecting from said electromagnet housing.

9. An electromagnet coil assembly as defined in claim 8, wherein said mounting plate has a plurality of countersunk apertures therein for facilitating the installation of said mounting plate onto the door frame.

10. An electromagnet coil assembly as defined in claim 8, additionally comprising:

engagement means between said electromagnet housing member and said mounting plate for removably engaging said electromagnet housing and said mounting plate prior to said mounting bolts being received into said mounting plate.

11. An electromagnet coil assembly as defined in claim 10, wherein said engagement means comprises:

an L-shaped projection extending from the side of said electromagnet housing member adjacent the bottom thereof; and a notch located in an edge of said mounting plate, said notch in said mounting plate being engaged by said L-shaped projection on said electromagnet housing member when said mounting plate is close adjacent the side of said electromagnet housing member which said L-shaped projection extends from.

12. An electromagnet coil assembly as defined in claim 1, wherein said electromagnet housing member is defined by two opposing side walls and a base wall and is open on a top side thereof and on opposite ends thereof, and wherein said electromagnet housing cover is U-shaped to enclose said open top side and said open ends of said electromagnet housing member when said electromagnet housing cover is installed onto said electromagnet housing member.

13. An electromagnet coil assembly as defined in claim 12, wherein said electromagnet housing cover comprises a thin cover plate forming the base of a "U" and two relatively thicker end walls forming the sides of the "U", said cover plate functioning to enclose said open top side of said electromagnet housing member and said end walls functioning to enclose said open ends of said electromagnet housing member.

14. An electromagnet coil assembly as defined in claim 13, wherein said electromagnet housing cover is secured to said electromagnet housing member by a plurality of bolts extending through side walls of said electromagnet housing member into tapped apertures located in said end walls of said electromagnet housing cover.

15. An electromagnet coil assembly as defined in claim 13, wherein said end walls of said electromagnet housing cover are located between said side walls of said electromagnet housing member, and wherein said bolt retaining means comprise:

at least one pair of coaxial and communicating apertures being transversely located in each of said two end walls of said electromagnet housing cover, one of said apertures in each pair being a relatively larger diameter aperture and the other of said apertures in each pair being a relatively smaller diameter aperture, said larger diameter apertures being oriented toward one side of said electromagnet housing cover and said smaller diameter apertures being oriented toward the other side of said electromagnet housing cover, said larger diameter apertures being designed to accommodate said heads of said mounting bolts, said smaller diameter apertures being designed to accommodate said shafts of said mounting bolts; and a plurality of apertures located in said side walls of said electromagnet housing member which are coaxial with said larger and smaller diameter apertures in said end walls of said electromagnet housing cover, said apertures in said side walls of said electromagnet housing member adjacent said smaller apertures being sufficiently large to allow said shafts of said mounting bolts to pass therethrough, said apertures in said side walls of said electromagnet housing member adjacent said larger apertures being too small to allow said heads of said mounting bolts to pass therethrough.

16. An electromagnet coil assembly as defined in claim 15, wherein said end walls of said electromagnet housing cover are sufficiently wide to contain said mounting bolts entirely therein.

17. An electromagnet coil assembly as defined in claim 1, wherein said electromagnet housing member is open on a top side thereof, and wherein said electromagnet housing cover is installed onto said electromagnet housing member to close said top side of said electromagnet housing member.

18. An electromagnet coil assembly as defined in claim 17, wherein said bolt retaining means comprise:

a plurality of bolt retaining apertures located in said electromagnet housing cover and extending transversely between opposing side walls inside said electromagnet housing member, each of said bolt retaining apertures containing a pair of coaxial and communicating cylindrical apertures therein, one of said cylindrical apertures in each pair being a relatively larger diameter aperture and the other of said cylindrical apertures in each pair being a relatively smaller diameter aperture, said larger diameter apertures being oriented toward one side of said electromagnet housing cover and said smaller diameter apertures being oriented toward the other side of said electromagnet housing cover, said larger diameter apertures being designed to accommodate said heads of said mounting bolts, said smaller diameter apertures being designed to accommodate said shafts of said mounting bolts; and a plurality of apertures located in said side walls of said electromagnet housing member which are coaxial with said larger and smaller diameter apertures in said cylindrical members within said electromagnet housing member, said apertures in said side walls of said electromagnet housing member adjacent said smaller apertures being sufficiently large to allow said shafts of said mounting bolts to pass therethrough.

19. An electromagnet coil assembly as defined in claim 18, wherein said apertures in said side walls of said electromagnet housing member adjacent said larger apertures are too small to allow said heads of said mounting bolts to pass therethrough.

20. An electromagnet coil assembly as defined in claim 1, wherein said electromagnet assembly is retained within said electromagnet housing member by a plurality of bolts extending through apertures in said electromagnet housing member and into tapped holes contained in said electromagnet assembly.

21. An electromagnet coil assembly as defined in claim 20, wherein said electromagnet housing cover comprises:

sides extending into the interior of said electromagnet housing member when said electromagnet housing cover is installed onto said electromagnet housing member, said sides of said electromagnet housing cover extending around the sides of said electromagnet assembly located within said electromagnet housing member, said plurality of bolts used to secure said electromagnet assembly extending through said apertures in said electromagnet housing member, then through apertures located in said sides of said electromagnet housing cover, and then into said tapped holes contained in said electromagnet assembly.

22. An electromagnet coil assembly for use in an electrically operated security system used to magnetically secure an exit door hingedly mounted in a door frame, the exit door having secured to it a magnetically attractable armature that is adapted to be attracted to and held by said electromagnetic coil assembly, said electromagnet coil assembly comprising:

a U-shaped channel member;

a plurality of thin, flat electromagnet core laminations which electromagnet core laminations are stacked together to form an array of electromagnet core laminations, wherein said array of electromagnet core laminations are placed into said U-shaped channel member;

thin weld beads securing the top edges of said U-shaped channel member to the sides of the electromagnet core laminations means, said thin weld beads thereby permanently retaining said array of electromagnet core laminations in fixed position within said U-shaped channel member;

an electromagnet coil winding mounted on said array of electromagnet core laminations, whereby said U-shaped channel together with said array of electromagnet core laminations and said electromagnet coil winding form an electromagnet assembly, said electromagnet assembly generating a magnetic field whenever said electromagnet coil winding is energized;

an electromagnet housing member having an opening therein, said electromagnet assembly being fixedly mounted within said electromagnet housing member;

an electromagnet housing cover for installation onto said electromagnet housing member to close said opening in said electromagnet housing member, said electromagnet housing member and said electromagnet housing cover together comprising an electromagnet housing;

mounting bolts for installing said electromagnet housing onto the door frame; and at least one pair of coaxial and communicating apertures being transversely located in said electromagnet housing, one of said apertures in each pair being a relatively larger diameter aperture and the other of said apertures in each pair being a relatively smaller diameter aperture, said larger diameter apertures being oriented toward one side of said electromagnet housing and said smaller diameter apertures being oriented toward the other side of said electromagnet housing, said larger diameter apertures being designed to accommodate said heads of said mounting bolts, said smaller diameter apertures being designed to accommodate said shafts of said mounting bolts.

23. An electromagnet coil assembly for use in an electrically operated security system used to magnetically secure an exit door hingedly mounted in a door frame, said electromagnet coil assembly comprising:

a U-shaped channel member;

a plurality of thin, flat electromagnet core laminations which electromagnet core laminations are stacked together to form an array of electromagnet core laminations, wherein said array of electromagnet core laminations are placed into said U-shaped channel member;

means for permanently retaining said array of electromagnet core laminations in fixed position within said U-shaped channel member;

an electromagnet coil winding mounted on said array of electromagnet core laminations to form an electromagnet assembly;

an electromagnet housing comprising an electromagnet housing member and an electromagnet housing cover, said electromagnet assembly being fixedly mounted within said electromagnet housing; and mounting hardware contained within said electromagnet housing and used for installing said electromagnet housing onto the door frame, said electromagnet housing providing access to allow a tool to drivingly engage said mounting hardware without requiring any disassembly of said electromagnet housing.

24. A method of making an electromagnet coil assembly for use in an electrically operated security system used to magnetically secure an exit door hingedly mounted in a door frame, the exit door having secured to it a magnetically attractable armature that is adapted to be attracted to and held by said electromagnetic coil assembly, said method comprising:

permanently retaining said array of thin, flat electromagnet core laminations within a U-shaped channel member;

mounting an electromagnet coil winding on said array of electromagnet core laminations, whereby said U-shaped channel together with said array of electromagnet core laminations and said electromagnet coil winding form an electromagnet assembly;

fixedly mounting said electromagnet assembly within an electromagnet housing member through an opening in said electromagnet housing member;

closing said opening in said electromagnet housing member by installing an electromagnet housing cover onto said electromagnet housing member, said electromagnet housing member and said electromagnet housing cover together comprising an electromagnet housing; and retaining mounting bolts within said electromagnet housing while providing access to allow a tool to drivingly engage said mounting bolts to mount said electromagnet housing to the door frame without requiring any disassembly of said electromagnet housing, said mounting bolts being used to install said electromagnet housing onto the door frame means.

* * * * *